US007475524B2

(12) United States Patent
Bordignon et al.

(10) Patent No.: US 7,475,524 B2
(45) Date of Patent: Jan. 13, 2009

(54) BAR PACKING PLANT AND RELATIVE PROCESS

(75) Inventors: Giuseppe Bordignon, Bicinicco (IT); Ivan Paiaro, Ronchi dei Legionari (IT); Andrea De Luca, Remanzacco (IT); Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 237 days.

(21) Appl. No.: 11/629,596

(22) PCT Filed: Jun. 16, 2005

(86) PCT No.: PCT/EP2005/052778

§ 371 (c)(1),
(2), (4) Date: Dec. 14, 2006

(87) PCT Pub. No.: WO2005/123292

PCT Pub. Date: Dec. 29, 2005

(65) Prior Publication Data

US 2007/0234774 A1 Oct. 11, 2007

(30) Foreign Application Priority Data

Jun. 16, 2004 (IT) ..... MI2004A1210

(51) Int. Cl.
*B65B 63/00* (2006.01)

(52) U.S. Cl. ..... 53/435; 53/513; 72/250; 72/419; 83/110

(58) Field of Classification Search ..... 53/435, 53/513; 72/419, 425, 426, 250, 251, 334; 83/110, 156; 198/370.02, 370.07, 461.1, 198/461.2, 459.3, 624, 625, 803.14, 890.1
See application file for complete search history.

(56) References Cited

U.S. PATENT DOCUMENTS

| | | | | | |
|---|---|---|---|---|---|
| 849,122 | A | * | 4/1907 | George | 198/625 |
| 2,726,754 | A | * | 12/1955 | Rodder | 198/625 |
| 2,959,268 | A | * | 11/1960 | McConnell | 198/625 |
| 3,497,084 | A | * | 2/1970 | Murrah | 100/7 |
| 3,610,437 | A | * | 10/1971 | Barakov et al. | 414/745.7 |
| 3,621,696 | A | * | 11/1971 | Norlindh | 72/201 |
| 4,054,047 | A | | 10/1977 | Sclippa | |
| 4,307,594 | A | | 12/1981 | Steinbock | |
| 4,840,015 | A | * | 6/1989 | Schultz | 53/435 |
| 5,058,725 | A | * | 10/1991 | Gamberini et al. | 198/625 |

(Continued)

FOREIGN PATENT DOCUMENTS

DE 3142698 A1 * 6/1982

(Continued)

*Primary Examiner*—Stephen F Gerrity
(74) *Attorney, Agent, or Firm*—Stetina Brunda Garred & Brucker

(57) ABSTRACT

Plant for packing bars after the rolling cycle comprising a feeding unit, a shear (45) for cutting the bar to size, a pair of deflector devices (46), (47) and a bar braking device. The bar segment deflector devices send the bar segments into seats (58) arranged along the perimeters of pairs of rotating cylinders (50), (51), (52), (53) and parallel to the axis of the cylinder, after making them pass through a bar braking device (48) to slow the bars down to the predefined speeds. The bars are unloaded from the seats onto conveyors (60), (61), (62), (63) and transported to a station where they are packed into bundles.

16 Claims, 12 Drawing Sheets

U.S. PATENT DOCUMENTS

| | | | | |
|---|---|---|---|---|
| 5,174,089 | A * | 12/1992 | Poloni | 53/446 |
| 5,191,818 | A * | 3/1993 | Mantovan et al. | 83/27 |
| 5,423,200 | A * | 6/1995 | Shore | 72/250 |
| 5,690,008 | A * | 11/1997 | Pong | 83/110 |
| 5,956,928 | A * | 9/1999 | Bordignon et al. | 53/444 |
| 6,192,729 | B1 | 2/2001 | Offoiach | |
| 2007/0277576 | A1 * | 12/2007 | Bordignon et al. | 72/250 |
| 2008/0196236 | A1 * | 8/2008 | Giuseppe et al. | 29/527.6 |

FOREIGN PATENT DOCUMENTS

| | | | |
|---|---|---|---|
| DE | 3635456 | A1 * | 8/1987 |
| EP | 411 688 | | 2/1991 |
| WO | WO 99/59757 | A1 * | 11/1999 |
| WO | WO 02/070156 | | 9/2002 |

* cited by examiner

BAR PACKING PLANT AND RELATIVE PROCESS

FIELD OF THE INVENTION

This invention relates to a bar packing plant, for example to pack steel bars for reinforced concrete.

BACKGROUND OF THE INVENTION

Various packing plants used in the production of packs or bundles of bars are known in the prior art. Said bars, that may have a different cross-section, are rolled before being cut and packed. One example of such a plant is described in Italian patent application UD95A000169. This document illustrates a system for delivering, reducing the speed of and unloading hot rolled bars onto the cooling bed. Said system, based on the use of two rotating drums with seats into which alternate bars are delivered, provides for a third channel-type device for delivering, reducing the speed of and unloading the bars, into which the last segment of the rolled bar, which is shorter than the previous segments, is delivered and then unloaded separately onto the cooling bed. A second example is described in document IT1231028. This patent describes a packing plant in which there is provided, downstream of a rotating shear for cutting the bars to the standard length, a device that slows down the cut bars and unloads these onto conveyors, said device comprising a plurality of drums mounted on a same shaft and arranged side by side and a short distance apart. The shaft is driven by a step motor and each drum has a plurality of chambers into which the cut bars are fed. Bar feed rollers and braking devices cooperate with the drums to unload the bars at the correct speed.

A third packing plant is described in document U.S. Pat. No. 4,307,594. In this case there is a single long rotating drum with retardation channels for the cut bars that are then unloaded onto the conveyor means.

The drawback of the systems known in the prior art is that they do not enable high speed packing of bars. Moreover, said systems are not very compact, which means they are expensive to produce. Finally, said systems do not allow for handling of shorter bar lengths, for example 6 m bars, which require much shorter cycle times.

These drawbacks have now been overcome with a new packing plant.

SUMMARY OF THE INVENTION

One of the main purposes of this invention is to produce a bar packing plant that, thanks to the innovative layout and operation of the components, permits a further reduction in the length of the production line, with a lower initial outlay thanks to the line's compactness.

Another purpose is to enable the bars, including the shortest bars, to be delivered at a higher speed and, thanks to the line's compactness, increase productivity and thus the speed at which the bars are processed.

This invention therefore overcomes the drawbacks described above according to a first aspect of the invention, with a bar packing plant, comprising means for transporting a bar of an undefined length along a trajectory parallel to its axis at a first speed, cutting-to-length devices to cut the bar into segments of a predefined length, means for diverting the bar segments in order to send said bar segments along a plurality of predefined directions, speed changing devices to adjust the speed of the bar segments so that said bar segments are delivered at predefined speeds other than the first speed, one or more pairs of cylinders installed side by side, defining respective axes and rotating about the respective axis, in which the cylinders have a plurality of seats along their respective perimeters, said seats being basically parallel to the axis of the respective cylinder, of a length that is at least twice that of the bar segments and having a proximal portion and a distal portion with respect to said braking means, and in which each of said predefined directions is parallel to the axis of a respective cylinder, conveyor means, each associated with and serving one of the proximal and distal portions of the seats (58), that transfer the bar segments to a subsequent packing station, after said segments have been unloaded from the seats in the cylinders.

According to a second aspect of the invention, the drawbacks described above have been overcome with a method for packing bars, performed by means of the previous plant comprising the following steps: a) cutting a bar of an undefined length into bar segments of a predefined length, b) diverting the bar segments towards a plurality of predefined lines, c) modifying the speed of the bar segments until the respective predefined speeds have been reached, d) cyclically feeding each bar segment, by means of an axial translation movement, alternately first into the portion of a first seat that is furthest from the braking means and then into the portion closest to the braking means of a second seat adjacent to the first, or vice versa, e) unloading each bar segment from a portion of a seat onto the conveyor means, associated with said portion, f) transferring the bar segments to a subsequent packing station. In particular, the advantages set forth above are achieved thanks to the use of a new internal structure of the packing plant, which provides for twin rotating drum channels with axially arranged peripheral seats that receive the bar sections, that are cut directly to the standard length by a cutting-to-length shear installed at the exit from the rolling mill.

Another factor that increases the productivity of the packing plant is a new method for unloading the segments from said channels onto the underlying conveyors of a discharge system. Said conveyors comprise a worm mechanism or worm assemblies to transfer the bar segments to one or more collection bags. A first passage phase, in which the segments are fed one at a time into the initial and final sectors of the peripheral seats until these are completely full, is followed by a steady state phase in which, for each bar segment inserted into a sector of a seat, another bar segment, inserted previously, is unloaded from the channel onto the conveyors.

With the process and plant according to this invention, standard length bar segments, for example 6 m segments, leaving a rolling train at high speeds, for example at 40 m/s, can be unloaded and slowed down.

The claims describe alternative preferred embodiments of the invention.

BRIEF DESCRIPTION OF THE DRAWINGS

Further characteristics and advantages of this invention will become clear from the following detailed description of a preferred, but not exclusive, embodiment of the invention, that is merely illustrative and not limitative, with the help of the drawings that are attached hereto, in which.

DETAILED DESCRIPTION OF PREFERRED EMBODIMENTS OF THE INVENTION

Figure 1A:
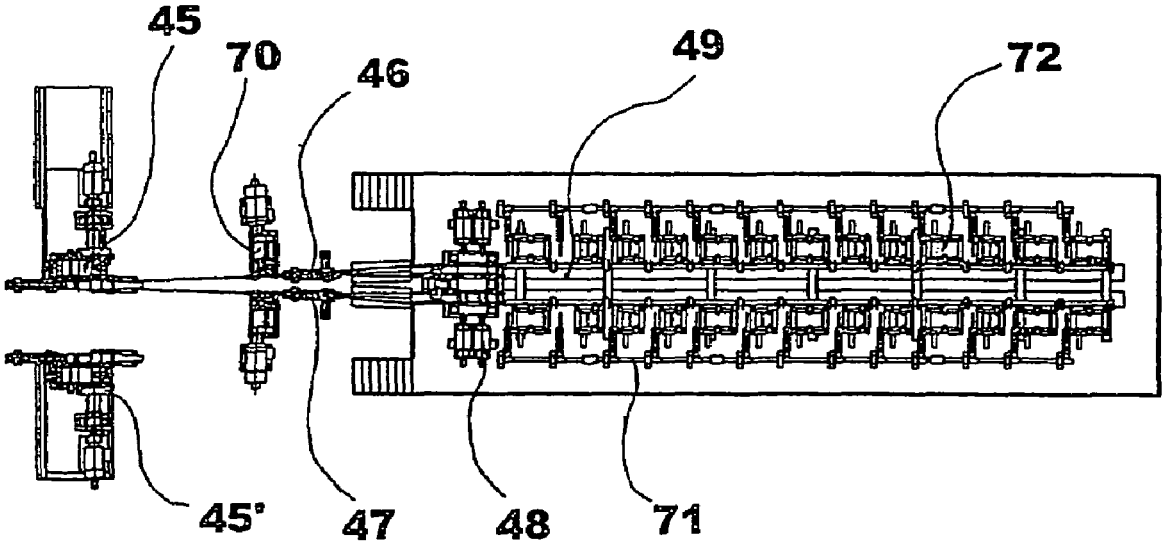
FIG. 1*a* is an elevation view of part of the plant according to this invention.

With reference to the drawings, a bar packing plant is now described. Said plant comprises:

- a cutting-to-length shear 45 with integrated deflector device;
- two deflector devices 46 and 47 that divert the bars towards four unloading lines;
- a four-way assembly, comprising four bar speed changers 48. For the sake of simplicity, in the following description reference is only made to one of the two functions of the speed changer, namely to that in which it is used as a brake, and it is simply called a bar braking device. The term bar braking device thus also refers to the case in which the bars are made to accelerate;
- two twin-channel rotating assemblies 49, i.e. four rotating drum channels 50, 51, 52, 53;
- a device with one or more conveyors 60, 61, 62, 63 to unload the bar segments.

Figure 1B:
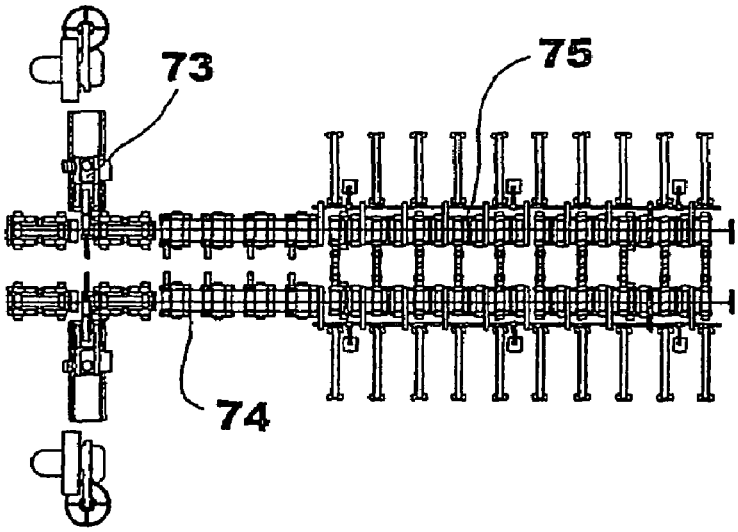
FIG. 1*b* is an elevation view of a second part of the plant in FIG. 1*a;*

The cutting-to-length shear 45 advantageously, but not necessarily, cuts the bars coming from a rolling mill, which is not illustrated in FIG. 1, to a predefined length. The bar segments thus obtained, hereafter also simply referred to as segments, are directed along two guideways leading from the cutting-to-length shear 45 by means of a deflector device that may be integrated into said cutting-to-length shear 45. The segments travel along the two guideways to the two deflector devices 46, 47 that direct them to four unloading lines.

At the beginning of the four unloading lines there is the bar braking assembly that comprises four bar braking devices 48. Each bar braking device 48 receives a bar segment with the rollers 55, 55', 59, 59' in the open position and rotating at a given speed. The bar segments preferably arrive at the bar braking device 48 from the right along the X axis. Upon leaving the bar braking device 48, said segments are fed into axially arranged peripheral seats 58 of rotating drum channels, also simply referred to as channels.

Control devices calculate the speed at which the bar segments must be released, upon completion of the braking action exerted by the bar braking device 48, according to the position that said segment must occupy in one of said seats and on the basis of the bar-seat friction coefficient. Said speed at which the segment is released is lower than that at which the segment arrives in case of workpieces with a small cross-segment and may be higher than that at which the segment arrives in case of workpieces with a large cross-segment. In this particular case the bar braking device accelerates the bar segments.

When the rollers 55, 55', 59, 59' of the bar braking device 48 receive the bar, they turn at the calculated release speed.

At a predefined moment, such to enable braking in the correct space and time, the rollers 55, 55', 59, 59' close on the segment and exert the braking action, exploiting the dynamic friction between the roller-segment.

During braking a motor controls the rollers 55, 55', 59, 59' via a train of gears 84, so that the peripheral speed of said rollers is the same as that calculated for unloading the segment. The speed at which the rollers 55, 55', 59, 59' rotate tends to increase due to the pull exerted by the segment on the rollers.

The actual release speed only coincides with the calculated speed, and thus with the peripheral speed of the rollers 55, 55', 59, 59' if the crushing force is sufficient to slow the bar to said calculated speed. The release speed may be higher than the calculated speed, but is guaranteed not to fall below said speed.

After a given time from the end of the braking phase, the rollers 55, 55', 59, 59' of the bar braking device 48 open to receive the next segment and accelerate or decelerate in order to adjust their peripheral speed to the new value that has been calculated to release the next segment, as said speed may be different to that required to unload the previous segment.

The braking effect is produced as the two upper rollers 55, 55', which can tilt, move towards the corresponding lower rollers 59, 59' that remain fixed in their position.

The fact that only the two upper rollers 55, 55' move means that the inertia involved is halved, reducing the impact on the bar and thus eliminating any risk of deformation.

The device that opens and closes the upper rollers 55, 55' reacts extremely rapidly and has very short response and actuation times. For example, the time available for closing the rollers 55, 55' is approximately 0.06 s.

Said device comprises, for each of the two upper rollers 55, 55' a mixed hydraulic-pneumatic system with two cylinders 56 and 57. One pneumatic cylinder 56 is of the push type and receives a constant pressure supply, with the pressure being equal to that needed to generate the braking force on the segment. This pneumatic cylinder 56 closes the rollers 55, 55' and is not controlled by a valve.

One hydraulic cylinder 57 is of the pull type and is controlled by a solenoid valve with short response times. When the rollers 55, 55' must close on the segment the solenoid valve is activated to reduce the hydraulic pressure of the cylinder 57, so that the pressure in the pneumatic cylinder 56 closes the rollers 55, 55' to reduce the speed of the segment.

At a given moment after the end of the braking phase, the rollers 55, 55' open as the solenoid valve is activated in order to restore the hydraulic pressure and thus the pulling pressure of the hydraulic cylinder 57.

The presence of two autonomous systems for opening and closing the upper rollers, one for the rollers 55 and one for the rollers 55', means that said rollers can be activated independently to ensure an even contact between the rollers and the bar that is being gripped, especially when handling ribbed bars for reinforced concrete.

The lower rollers 59, 59' are not of the tilting type but can be adjusted, as a function of the cross-section of the bar to be slowed, by means of a single device 80 that acts, via a tie rod 81, on the roller holder lever 82 of one of the two lower rollers 59, 59'. The movement of said lever 82 activates the corresponding lever of the other roller by means of a gearwheel coupling between said levers.

Figure 2:
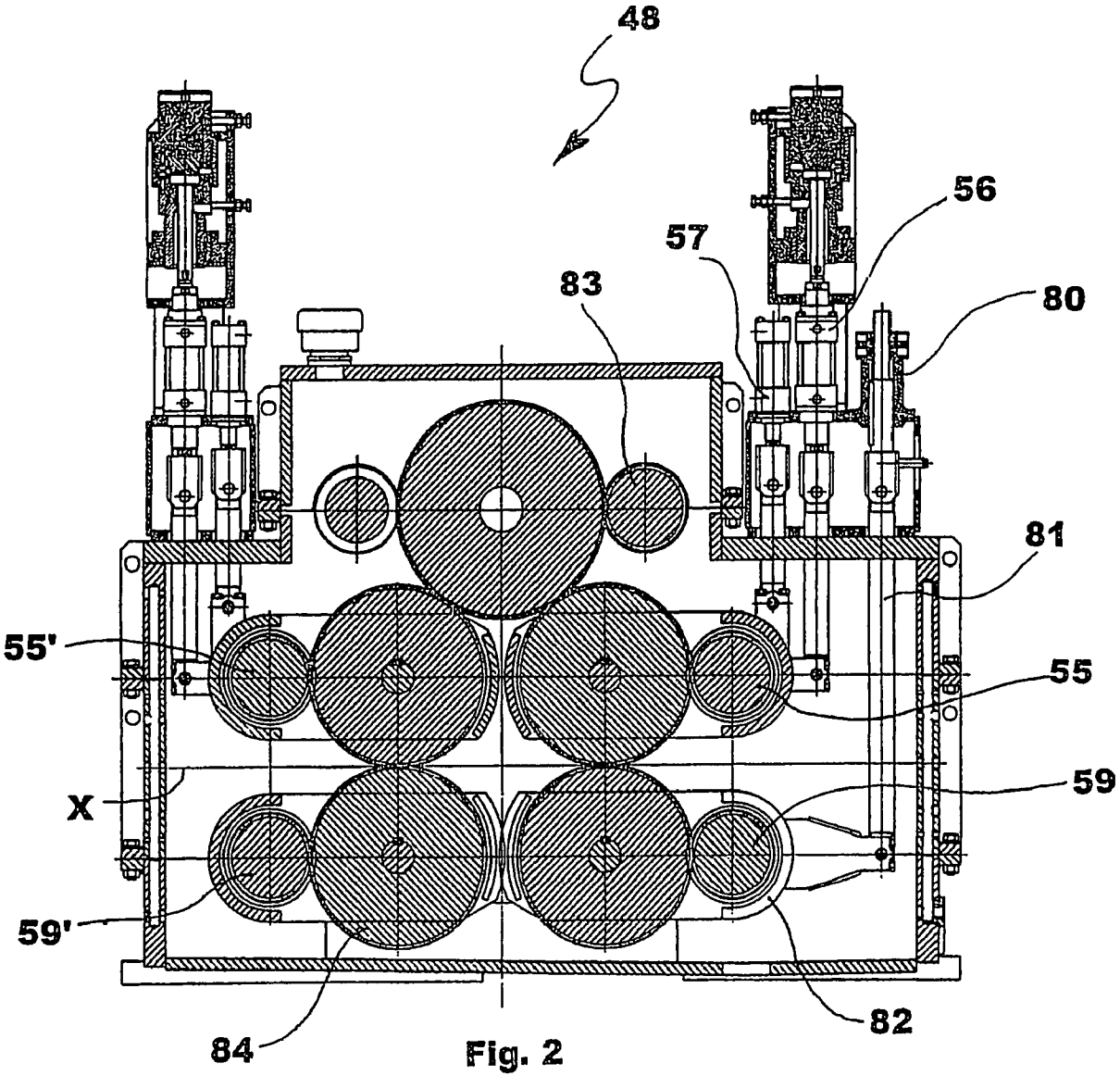
FIG. 2 is a cross-segment of the bar braking device belonging to the plant in FIG. 1*a;*
Figure 3:
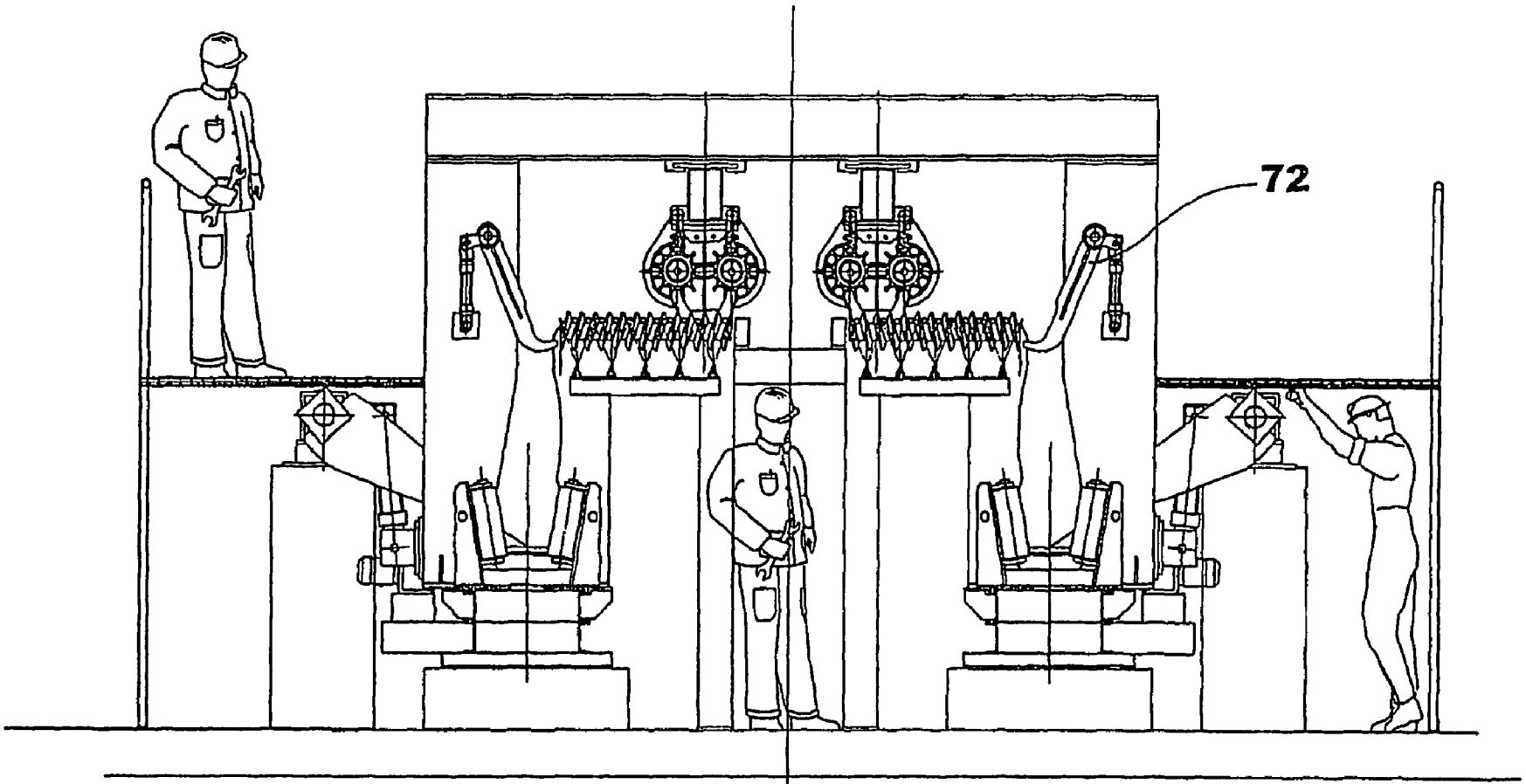
FIG. 3 is a side view of some parts of the plant according to this invention.

The rotation mechanism of the rollers 55, 55', 59, 59' comprises a driving motor 83 and a train of gears 84, as illustrated in FIG. 2.

According to one advantageous alternative form of this invention, more than one pair of upper and lower rollers can be used for each bar braking device.

According to another advantageous alternative form of this invention, pairs of upper and lower rotating means, having their respective axes of rotation basically orthogonal to the feed axis of the bar segments, can be used to transmit motion to respective upper and lower tracked belts, wrapped around said rotating means. In this way the braking action, or acceleration, is exerted on the bar segment by means of the friction between said segment and the upper and lower tracked belts.

The segments, cut to a standard length and slowed down as described above, are then fed into the axially arranged peripheral seats 58 in the channels.

The system used to unload the bar segments, illustrated in the drawings, comprises four rotating drum channels 50, 51, 52, 53. The length of said channels is equal to at least twice the length of the segments and their peripheral seats 58 are divided into two sectors, an initial sector and a final sector, that are at least as long as one bar segment. For example, in case of segments that are 6 m long, the length of the initial and final sectors of the seats 58 is respectively 6 m plus a safety distance. The length of the channel is thus at least 12 m plus the safety distance.

Under the channels 50, 51, 52, 53, there is a device that collects and removes the segments that have been unloaded from said channels. Said removal device may comprise one or more conveyors. Said conveyors, for example, comprise a worm or worm assembly capable of transferring the segments, basically orthogonally or in any case transversely in relation to their axis, to one or more collection bags, or to guideways or roller conveyors. In the example illustrated in the drawings, the four conveyors 60, 61, 62, 63 can be operated separately and the screws that are used are of the double-threaded type, but other screws may be used. The conveyors 60 and 62 deliver segments to the final sectors of the seats 58; the conveyors 61 and 63 deliver segments to the initial sectors of said seats.

A first passage phase in which the segments are delivered one at a time alternately into the initial and final sectors of the peripheral seats 58 in sequence until these are completely full, is followed by a steady state phase in which, for each segment delivered into a sector of a seat 58, another segment, that was delivered previously, is unloaded from the channel onto the relative conveyor. The unloading operation, which is described below, makes it possible to reduce the time required to transport the segments on the conveyors 60, 61, 62, 63, once they have been unloaded from the channels 50, 51, 52, 53, compared to systems known in the prior art.

Figure 4B:
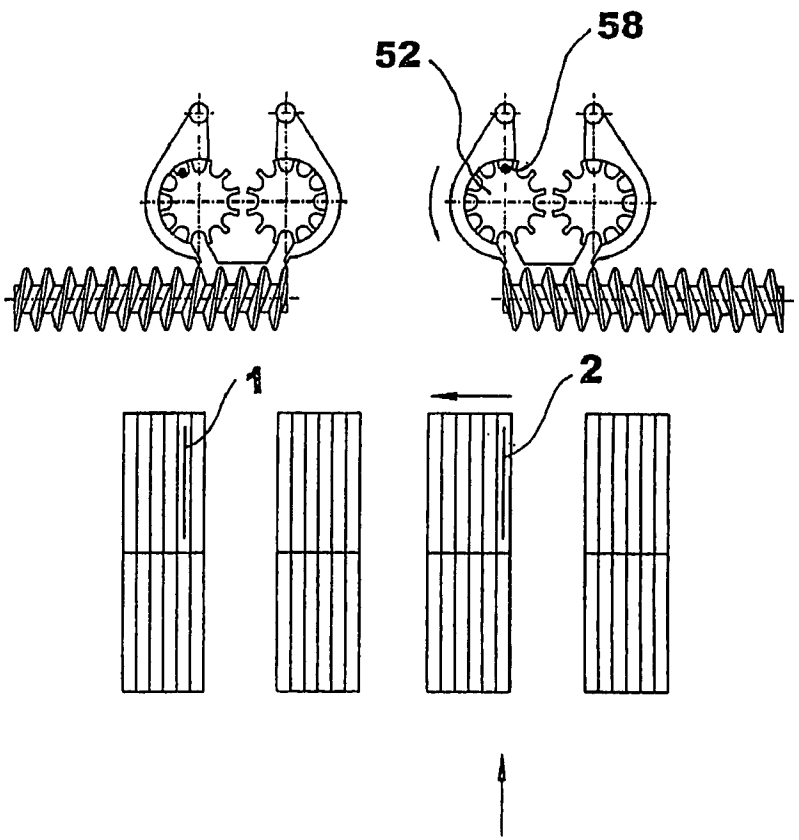
FIGS. 4*a* to 4*h* illustrate a first sequence of steps that comprise the process when the plant according to this invention is started.
Figure 4A:
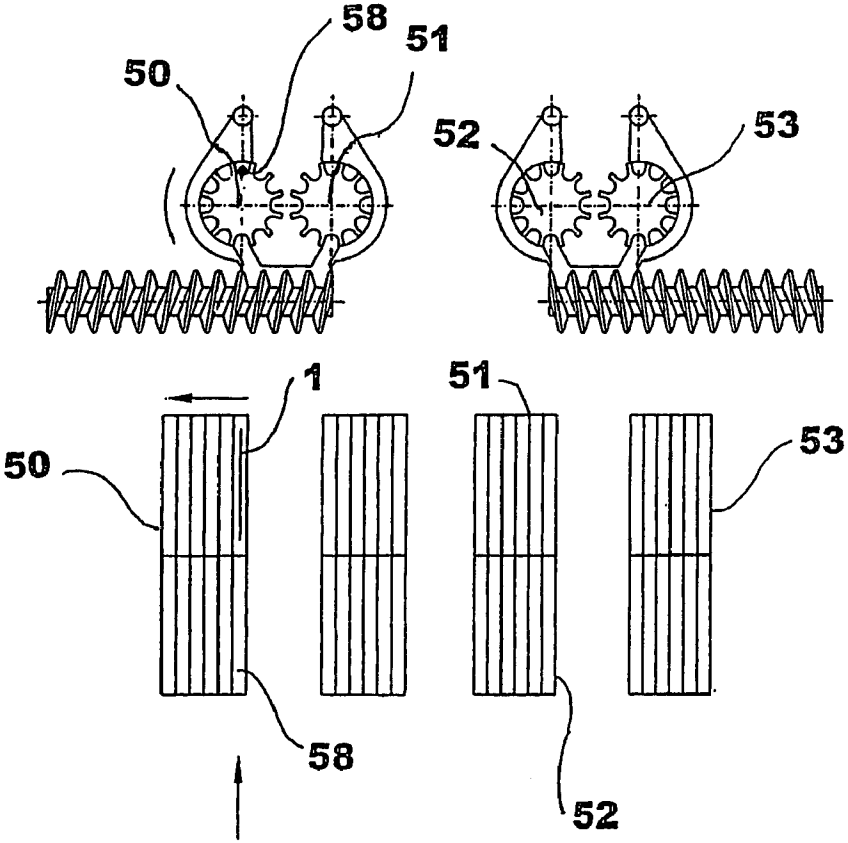
Figure 4D:
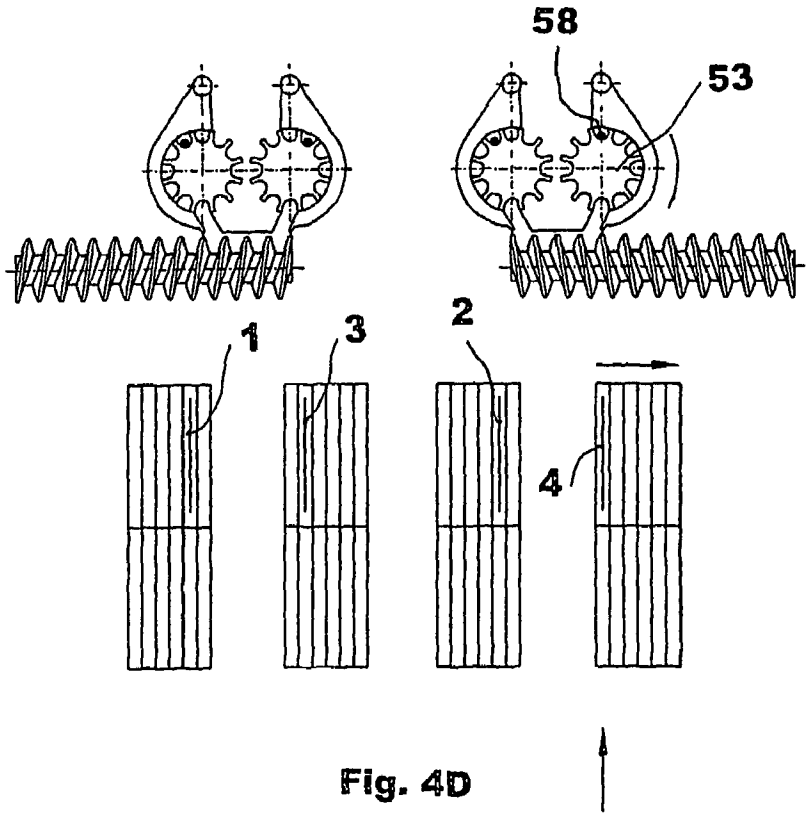

In the passage phase the segments, the flow of which is indicated by the arrows at the bottom of FIGS. 4*a* to 4*h*, are fed into the peripheral seats 58 of the four rotating drum channels 50, 51, 52, 53 as described below:

1. the segment 1 is fed into a seat 58 in the channel 50 at a first speed such that it is able to stop in the final portion of said channel 50 (FIG. 4*a*). Said speed is controlled by the bar braking device 48. Once the tail end of segment 1 has entered the seat 58, the channel 50 starts to rotate so that it is ready to receive segment 5 in the initial sector of the next seat; (FIG. 4*e*)

2. segment 2 is fed into a seat 58 in the channel 52 at a speed such that it is able to stop in the final sector of said channel 52 (FIG. 4*b*). Once the tail end of segment 2 has entered the seat, it starts to rotate so that it is ready to receive segment 6 in the initial sector of the next seat; (FIG. 4*f*)

Figure 4C:
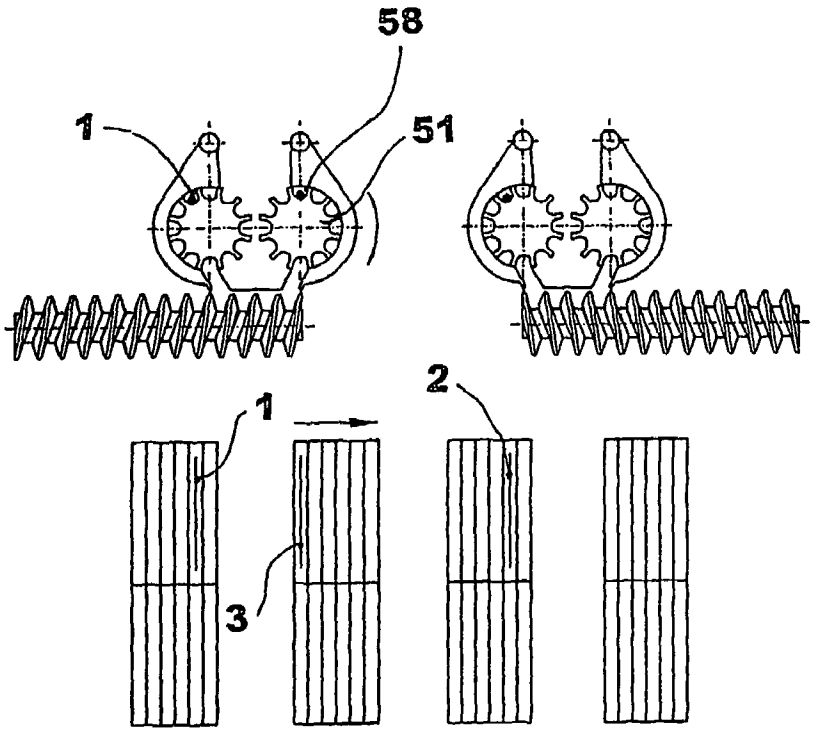
Figure 4F:
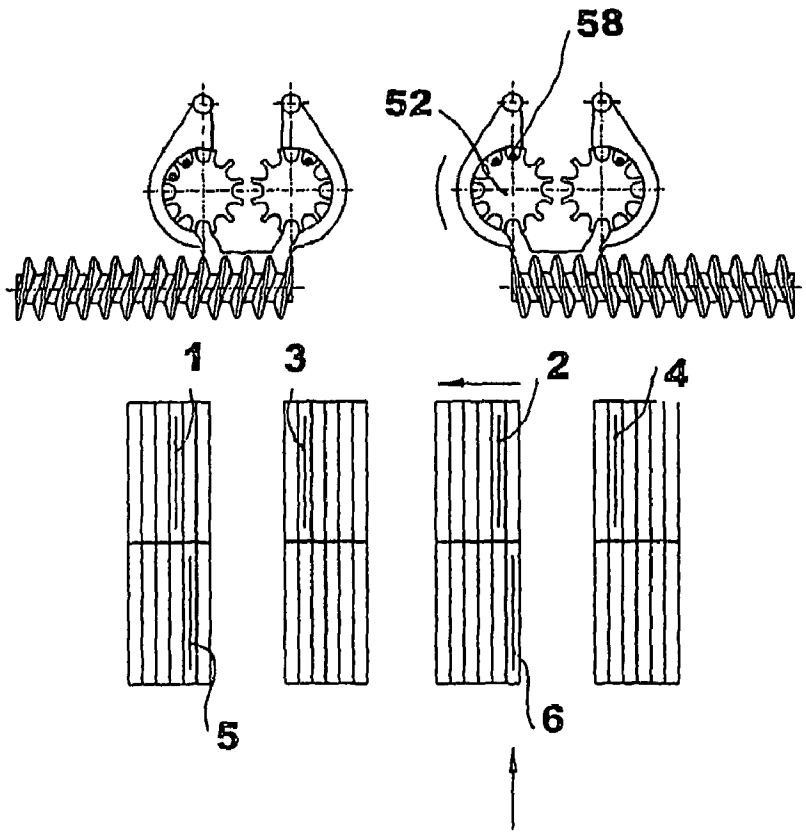
Figure 4E:
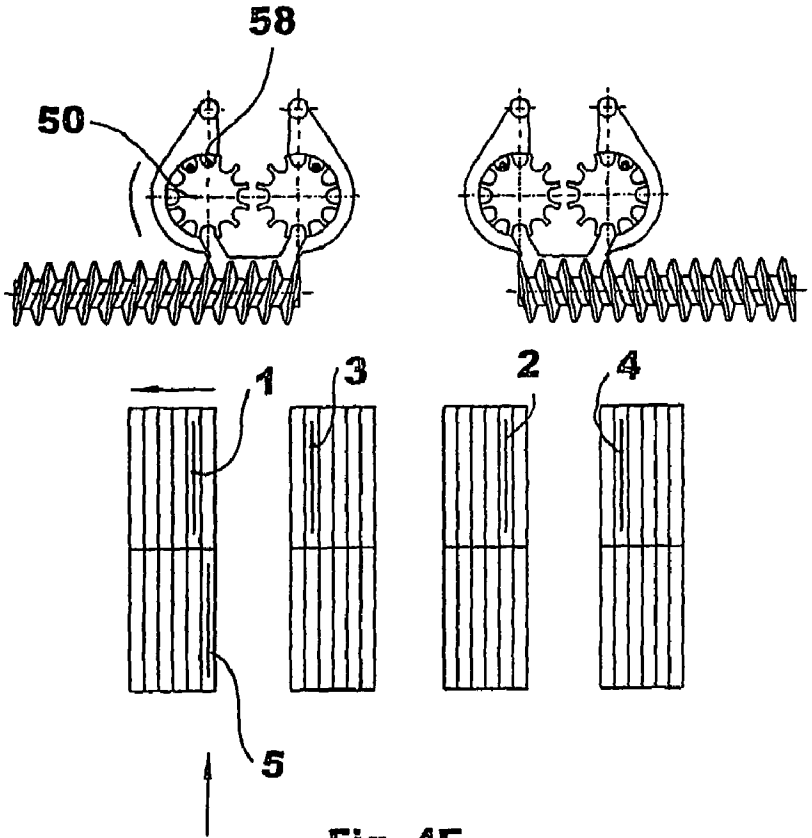
Figure 4H:
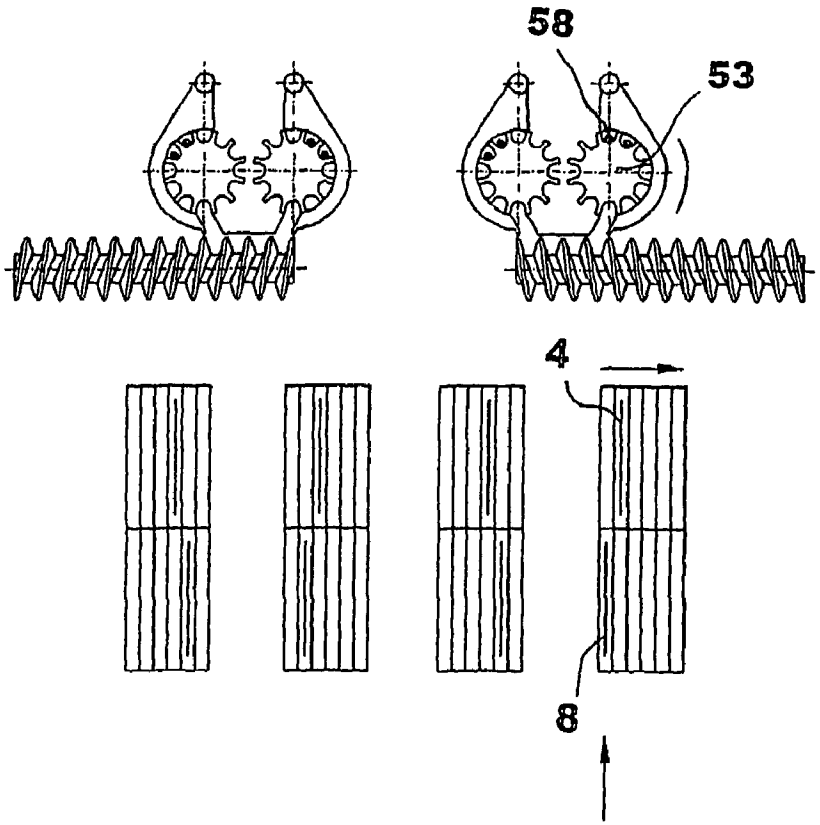
Figure 4G:
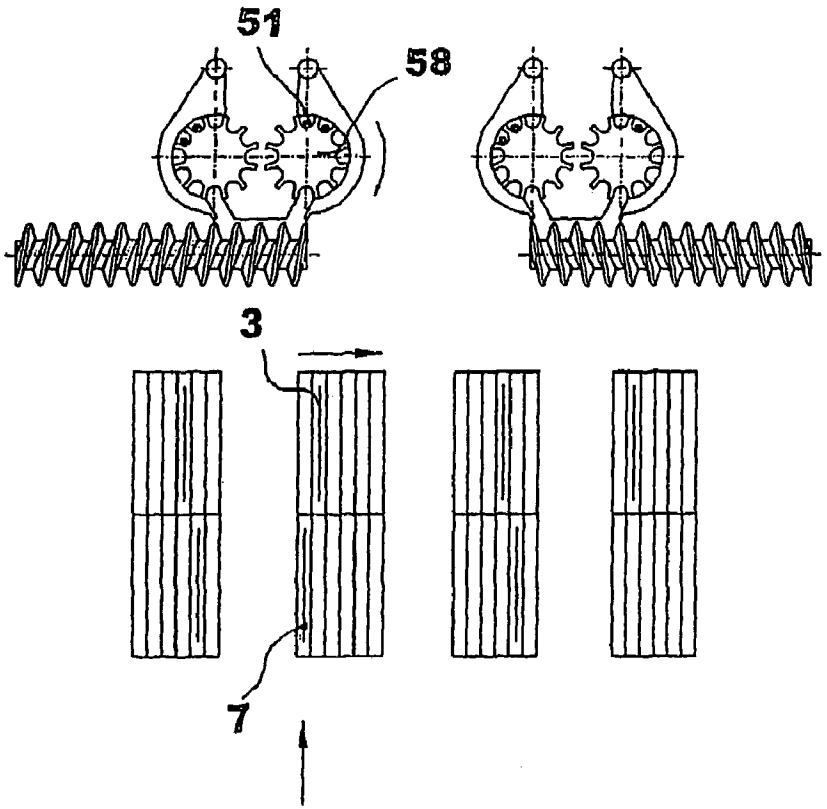
Figure 5B:
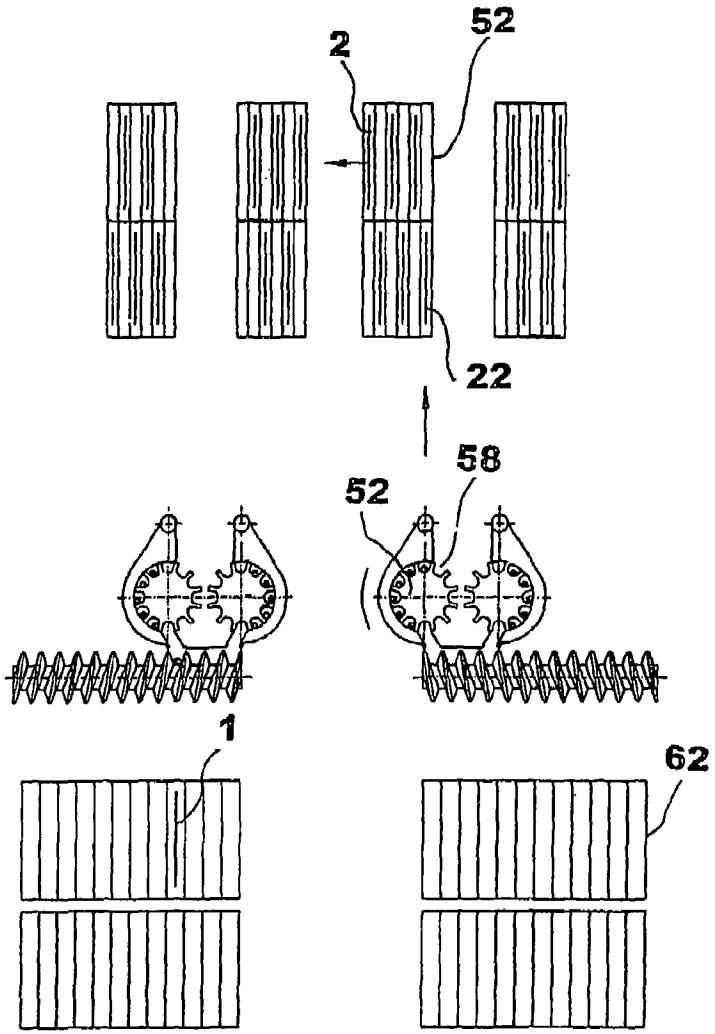
FIGS. 5*a* to 5*h* illustrate a second sequence of steps that comprise the process during steady state operation of the plant according to this invention.
Figure 5A:
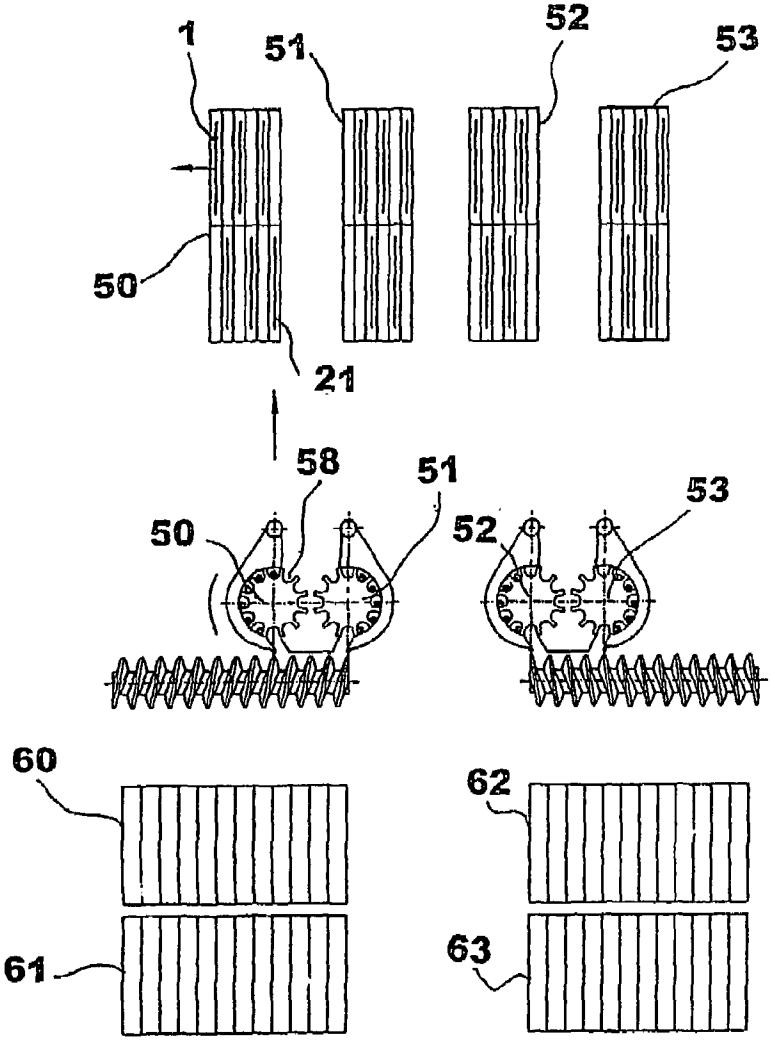
Figure 5D:
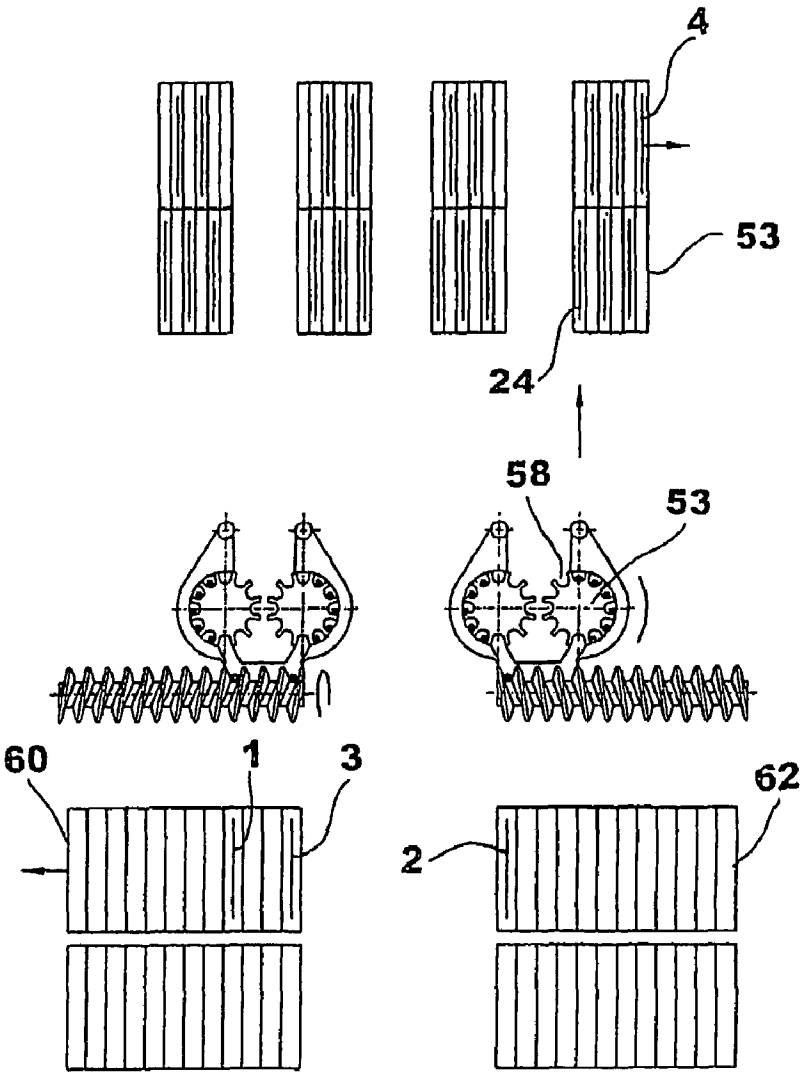
Figure 5C:
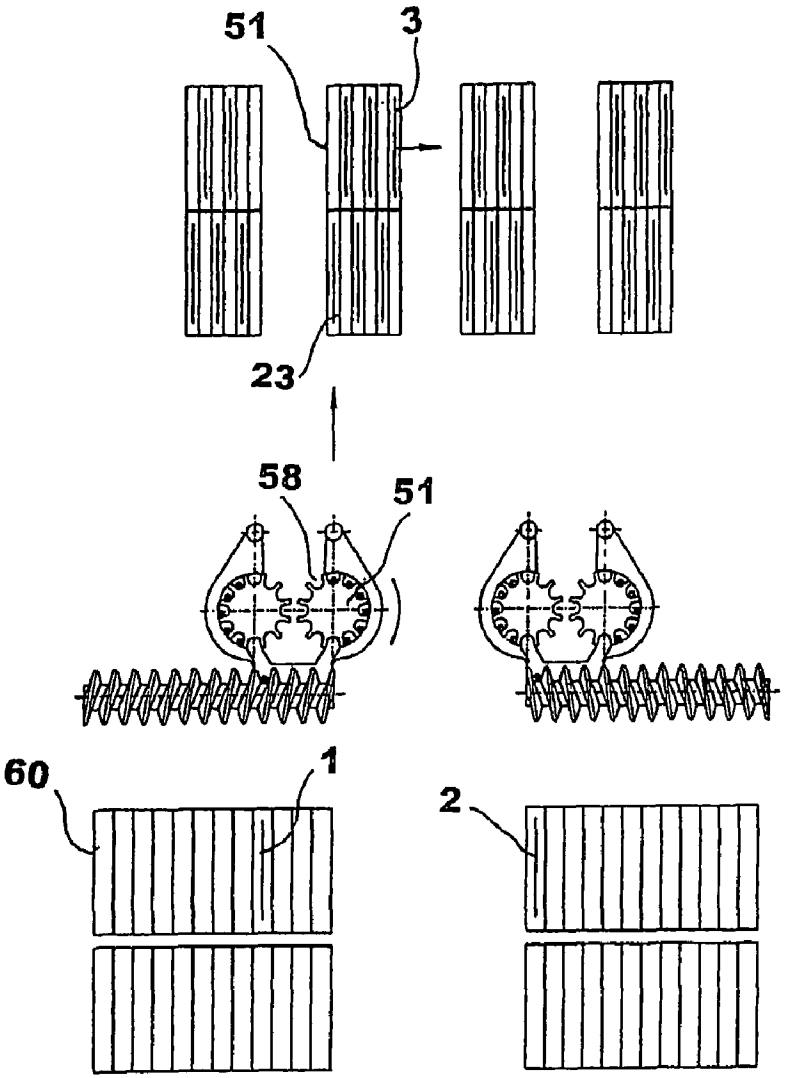
Figure 5F:
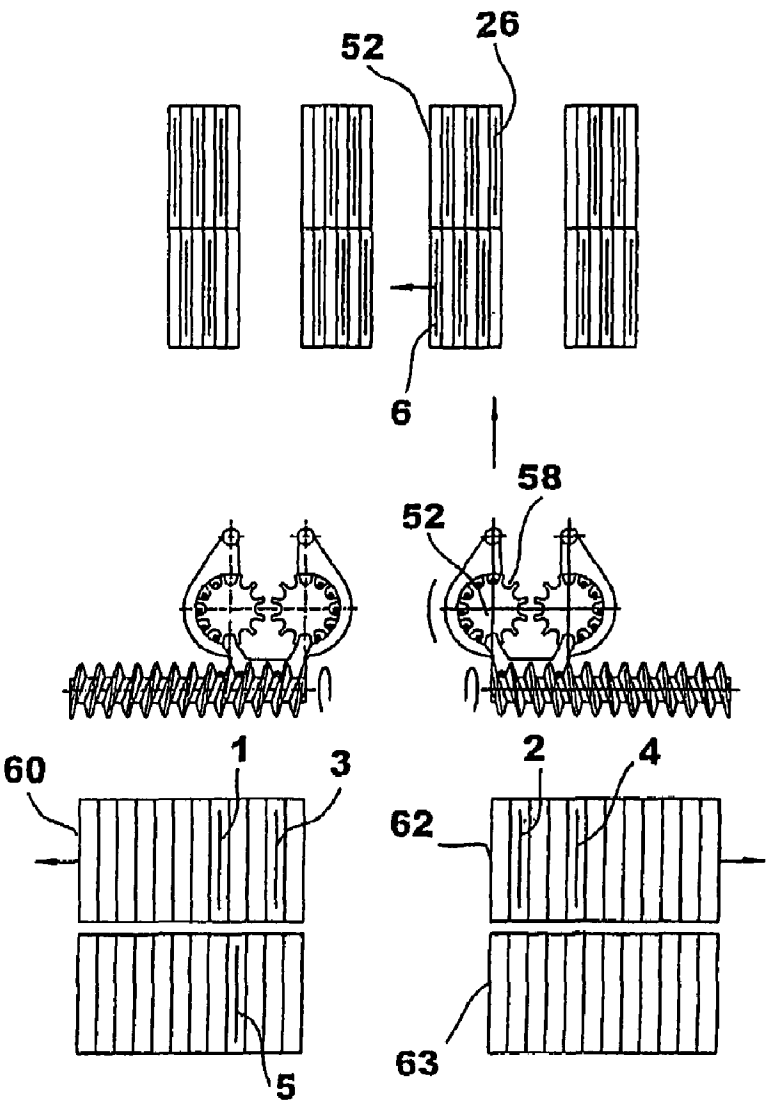
Figure 5E:
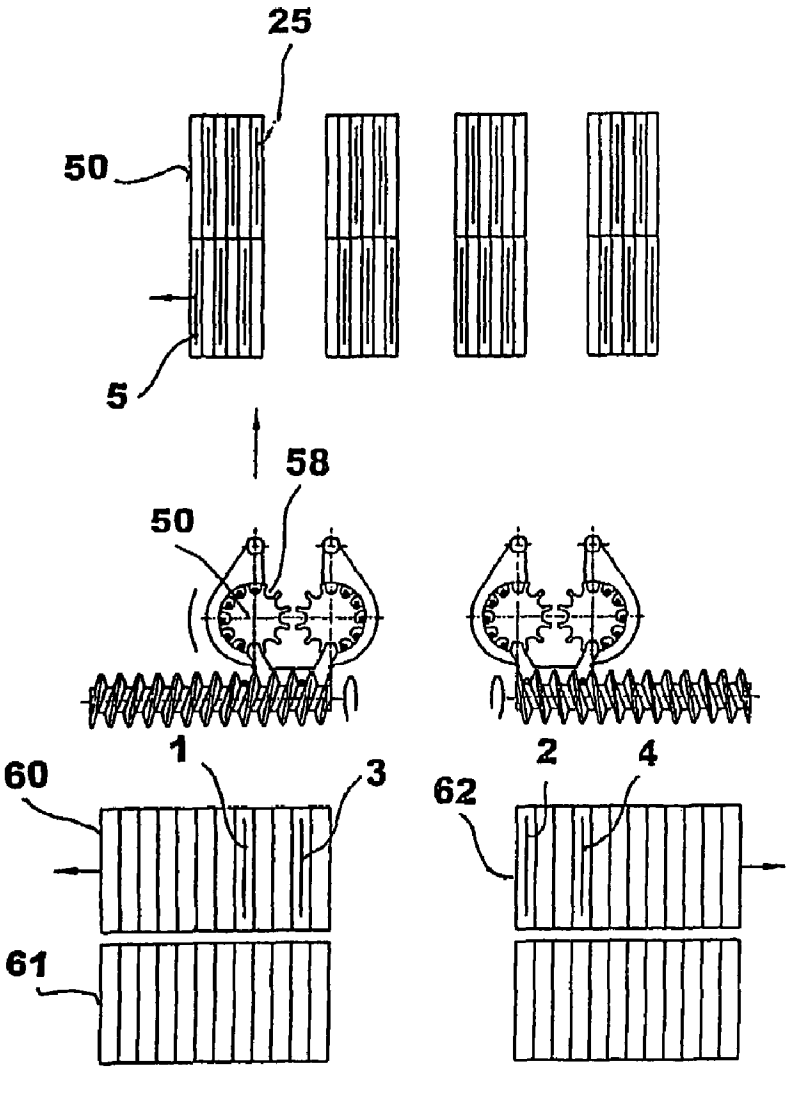
Figure 5H:
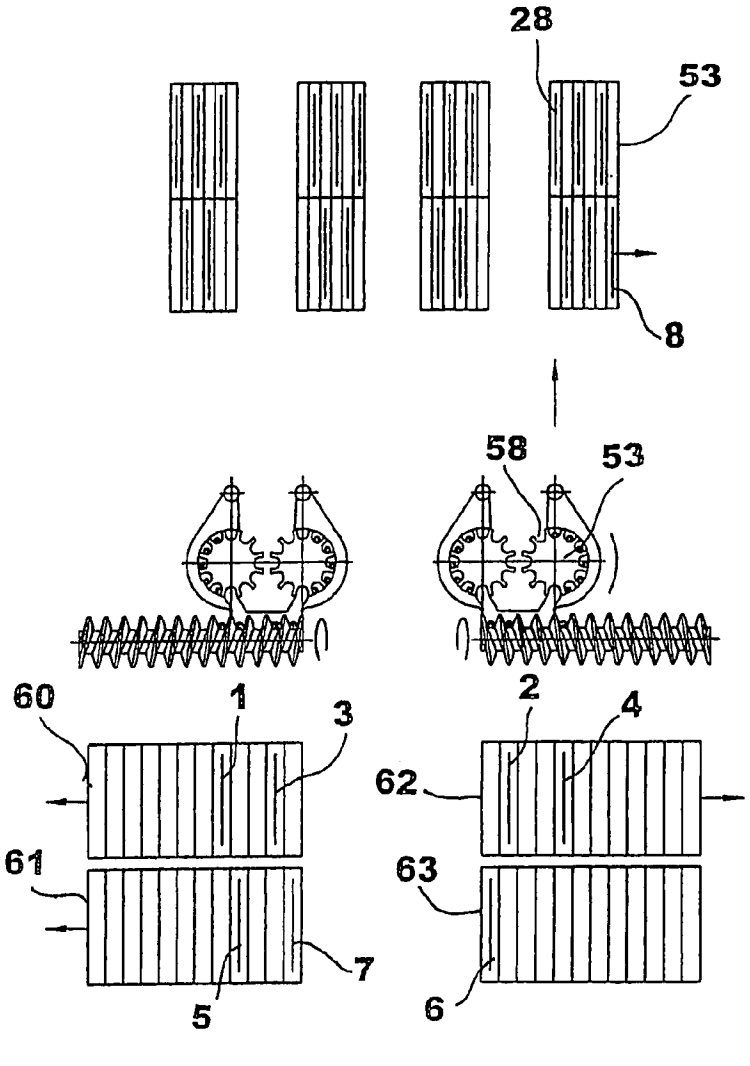
Figure 5G:
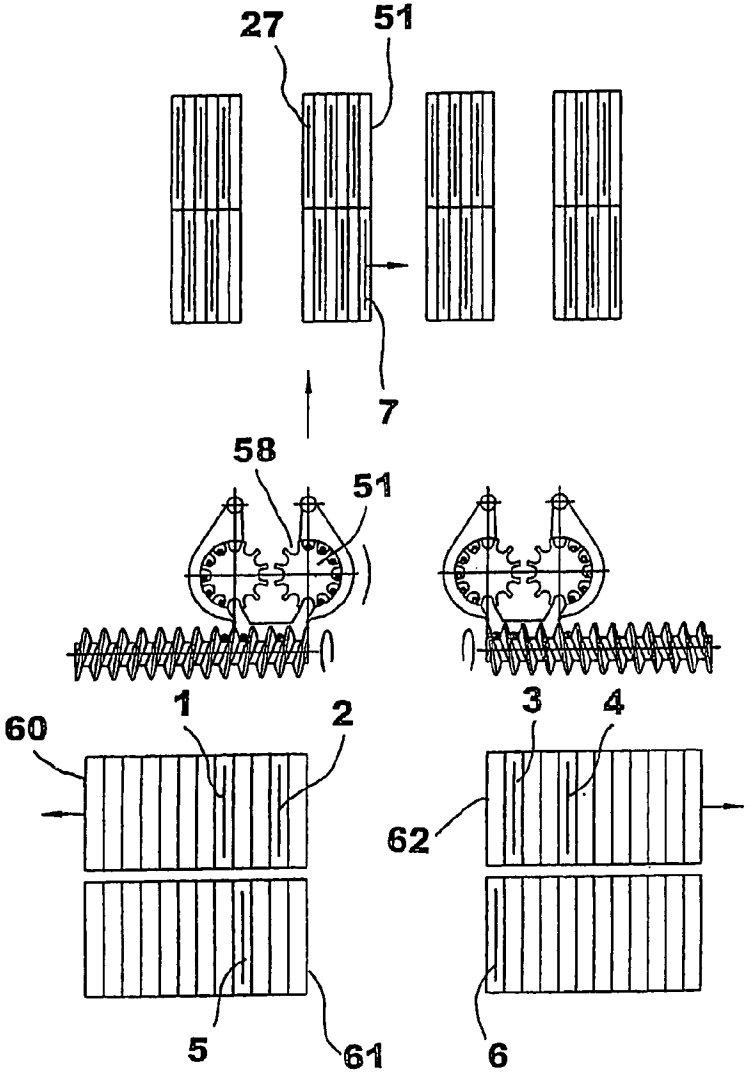

3. segment 3 is fed into a seat 58 in the channel 51 at a speed such that it is able to stop in the final sector of said channel 51 (FIG. 4*c*). Once the tail end of segment 3 has entered the seat, it starts to rotate so that it is ready to receive segment 7 in the initial sector of the next seat; (FIG. 4*g*)

4. segment 4 is fed into a seat 58 in the channel 53 at a speed such that it is able to stop in the final sector of said channel 53 (FIG. 4*d*). Once the tail end of segment 4 has entered the seat, it starts to rotate so that it is ready to receive segment 8 in the initial sector of the next seat; (FIG. 4*h*)

5. segment 5 is fed into a seat 58 in the channel 50, after that of segment 1, at a second speed such that it is able to stop in the initial sector of said channel 50 (FIG. 4*e*). The second speed of the segments is also controlled by the bar braking device 48. Once the tail end of segment 5 has entered the seat, it starts to rotate so that it is ready to receive segment 9 in the final sector of the next seat;

6. segment 6 is fed into a seat 58 in the channel 52, after that of segment 2, at a speed such that it is able to stop in the initial sector of said channel 52 (FIG. 4*f*). Once the tail end of segment 6 has entered the seat, it starts to rotate so that it is ready to receive segment 10 in the final sector of the next seat;

7. segment 7 is fed into a seat 58 in the channel 51, after that of segment 3, at a speed such that it is able to stop in the initial sector of said channel 51 (FIG. 4*g*). Once the tail end of segment 7 has entered the seat, it starts to rotate so that it is ready to receive segment 11 in the final sector of the next seat;

8. segment 8 is fed into a seat 58 in the channel 53, after that of segment 4, at a speed such that it is able to stop in the initial sector of said channel 53 (FIG. 4*h*). Once the tail end of segment 8 has entered the seat, it starts to rotate so that it is ready to receive segment 12 in the final sector of the next seat;

9. the cycle is repeated from step 1) with segment 9.

When the initial and final portions of all the peripheral seats 58 in the four rotating drum channels 50, 51, 52, 53 are full, the packing plant steady state phase starts in which the segments are unloaded onto the conveyors 60, 61, 62, 63 and transferred to the collection bags and new segments are loaded into the empty seats. The segment unloading process consists of the following steps, as illustrated in FIGS. 5*a* to 5*h:* a. after segment 21 has been fed into the initial portion of a seat 58 in the channel 50, said channel starts to rotate in order to unload segment 1 onto the relative conveyor 60;

b. after segment 22 has been fed into the initial portion of a seat 58 in the channel 52, said channel starts to rotate in order to unload segment 2 onto the relative conveyor 62;

c. after segment 23 has been fed into the initial sector of a seat 58 in the channel 51, said channel starts to rotate in order to unload segment 3 onto the relative conveyor 60. Said conveyor starts to translate the relative segments, transversely in relation to its axis, moving them by one screw pitch and thus by two spaces, since in this embodiment double-threaded screws are used;

d. after segment 24 has been fed into the initial sector of a seat 58 in the channel 53, said channel starts to rotate in order to unload segment 4 onto the relative conveyor 62. Said conveyor starts to translate the relative segments, moving them by one screw pitch and thus by two spaces.

The conveyor 60 continues to translate segments 1 and 3;

e. after segment 25 has been fed into the final sector of a seat 58 in the channel 50, said channel starts to rotate in order to unload segment 5 onto the relative conveyor 61. The conveyors 60 and 62 continue to translate segments 1, 3 and 2, 4 respectively;

f. after segment 26 has been fed into the final sector of a seat 58 in the channel 52, said channel starts to rotate in order to unload segment 6 onto the relative conveyor 63. The conveyors 60 and 62 continue to translate segments 1, 3 and 2, 4 respectively;

g. after segment 27 has been fed into the final sector of a seat 58 in the channel 51, said channel starts to rotate in order to unload segment 7 onto the relative conveyor 61. Said conveyor starts to translate the relative segments, moving them by one screw pitch and thus by two spaces. The conveyors 60 and 62 continue to translate segments 1, 3 and 2, 4 respectively;

h. after segment 28 has been fed into the final sector of a seat 58 in the channel 53, said channel starts to rotate in order to unload segment 8 onto the relative conveyor 63. Said conveyor starts to translate the relative segments, moving them by one screw pitch and thus by two spaces. The conveyor 60 stops to receive segments 9 and 11. The conveyors 62 and 61 continue to translate segments 2, 4 and 5, 7 respectively;

i. after segment 29 has been fed into the initial sector of a seat 58 in the channel 50, said channel starts to rotate in order to unload segment 9 onto the relative conveyor 60. The conveyor 62 stops to receive segments 10 and 12. The conveyors 61 and 63 continue to translate segments 5, 7 and 6, 8 respectively;

j. after segment 30 has been fed into the initial sector of a seat 58 in the channel 52, said channel starts to rotate in order to unload segment 10 onto the relative conveyor 62. The conveyors 61 and 63 continue to translate segments 5, 7 and 6, 8 respectively;

k. after segment 31 has been fed into the initial sector of a seat 58 in the channel 51 said channel starts to rotate in order to unload segment 11 onto the relative conveyor 60. Said conveyor starts to translate the relative segments, moving them by one screw pitch and thus by two spaces. The conveyors 61 and 63 continue to translate segments 5, 7 and 6, 8 respectively;

l. after segment 32 has been fed into the initial sector of a seat 58 in the channel 53, said channel starts to rotate in order to unload segment 12 onto the relative conveyor 62. Said conveyor starts to translate the relative segments, moving them by one screw pitch and thus by two spaces. The conveyor 61 stops to receive segments 13 and 15. The conveyors 60 and 63 continue to translate segments 1, 3, 9, 11 and 6, 8 respectively;

m. after segment 33 has been fed into the final sector of a seat 58 in the channel 50, said channel starts to rotate in order to unload segment 13 onto the relative conveyor 61. The conveyor 63 stops to receive segments 14 and 16. The conveyors 60 and 62 continue to translate segments 1, 3, 9, 11 and 2, 4, 10, 12 respectively;

n. after segment 34 has been fed into the final sector of a seat 58 in the channel 52, said channel starts to rotate in order to unload segment 14 onto the relative conveyor 63. The conveyors 60 and 62 continue to translate segments 1, 3, 9, 11 and 2, 4, 10, 12 respectively;

o. after segment 35 has been fed into the final sector of a seat 58 in the channel 51, said channel starts to rotate in order to unload segment 15 onto the relative conveyor 61. Said conveyor starts to translate the relative segments, moving them by one screw pitch and thus by two spaces. The conveyors 60 and 62 continue to translate segments 1, 3, 9, 11 and 2, 4, 10, 12 respectively;

p. after segment 36 has been fed into the final sector of a seat 58 in the channel 53, said channel starts to rotate in order to unload segment 16 onto the relative conveyor 63. Said conveyor starts to translate the relative segments, moving them by one screw pitch and thus by two spaces. The conveyor 60 stops to receive segments 17 and 19. The conveyors 61 and 62 continue to translate segments 5, 7, 13, 15 and 2, 4, 10, 12 respectively;

q. after segment 37 has been fed into the initial sector of a seat 58 in the channel 50, said channel starts to rotate in order to unload segment 17 onto the relative conveyor 60. The conveyor 62 stops to receive segments 18 and 20. The conveyors 61 and 63 continue to translate segments 5, 7, 13, 15 and 6, 8, 14, 16 respectively;

r. after segment 38 has been fed into the initial portion of a seat 58 in the channel 52, said channel starts to rotate in order to unload segment 18 onto the relative conveyor 62. The conveyors 61 and 63 continue to translate bars 5, 7, 13, 15 and 6, 8, 14, 16 respectively;

s. after segment 39 has been fed into the initial sector of a seat 58 in the channel 51, said channel starts to rotate in order to unload segment 19 onto the relative conveyor 60. Said conveyor starts to translate the relative segments, moving them by one screw pitch and thus by two spaces. The conveyors 61 and 63 continue to translate segments 5, 7, 13, 15 and 6, 8, 14, 16 respectively;

t. after segment 40 has been fed into the initial sector of a seat 58 in the channel 53, said channel starts to rotate in order to unload segment 20 onto the relative conveyor 62. Said conveyor starts to translate the relative segments, moving them by one screw pitch and thus by two spaces. The conveyor 61 stops to receive segments 21 and 23. The conveyors 60 and 63 continue to translate segments 1, 3, 9, 11, 17, 19 and 6, 8, 14, 16 respectively;

u. after segment 41 has been fed into the final sector of a seat 58 in the channel 50, said channel starts to rotate in order to unload segment 21 onto the relative conveyor 61. The conveyor 63 stops to receive segments 22 and 24. The conveyors 60 and 62 continue to translate segments 1, 3, 9, 11, 17, 19 and 2, 4, 10, 12, 18, 20 respectively;

v. after segment 42 has been fed into the final sector of a seat 58 in the channel 52, said channel starts to rotate in order to unload segment 22 onto the relative conveyor 63. The conveyors 60 and 62 continue to translate segments 1, 3, 9, 11, 17, 19 and 2, 4, 10, 12, 18, 20 respectively;

w. after segment 43 has been fed into the final sector of a seat 58 in the channel 51, said channel starts to rotate in order to unload segment 23 onto the relative conveyor 61. Said conveyor starts to translate the relative segments, moving them by one screw pitch and thus by two spaces. The conveyors 60 and 62 continue to translate segments 1, 3, 9, 11, 17, 19 and 2, 4, 10, 12, 18, 20 respectively;

x. after segment 44 has been fed into the final sector of a seat 58 in the channel 53, said channel starts to rotate in order to unload segment 24 onto the relative conveyor 63. Said conveyor starts to translate the relative segments, moving them by one screw pitch and thus by two spaces. The conveyor 60 stops to receive segments 25 and 27. The conveyors 61 and 62 continue to translate segments 5, 7, 13, 15 and 2, 4, 10, 12, 18, 20 respectively;

y. the cycle is repeated in the same way from point a).

With this layout of the components and when the segments are delivered into and unloaded from the rotating drum channels as described above, this packing plant is capable, for example, with segments ranging from between 6 m and 12 m in length and with 610 mm diameter bars arriving at speeds of 40 m/s and 36 mm diameter bars arriving at speeds of 4 m/s, of a production output of 100 t/h.

The main advantages of the layout and structure of the components described above are:

- reduced line length; in conventional plants the bars are 60÷80 m in length, which means that the channel must be longer, whereas the length of the channel according to this invention is, for example, approximately 21 m;
- reduced initial outlay due to the compactness of the line, since more compact components take up less floor-space in the workshop;
- reduced initial outlay due to the fact that the bars are cut directly to the standard length so there is no need for a cooling bed or cutting-to-length shear downstream of the channels;
- higher productivity of the bar packing plant compared to conventional systems.

Cutting the bars directly to the standard length means a large number of cutting operations are performed within a given time, with an increase of approximately 30% compared to the current number of cutting operations. This means that the blades of the shear are subject to considerable wear. For this reason the material used to manufacture the blades must be chosen from among those that currently offer the best resistance to wear, in order to ensure the longest possible service life of the blades.

Figure 6:
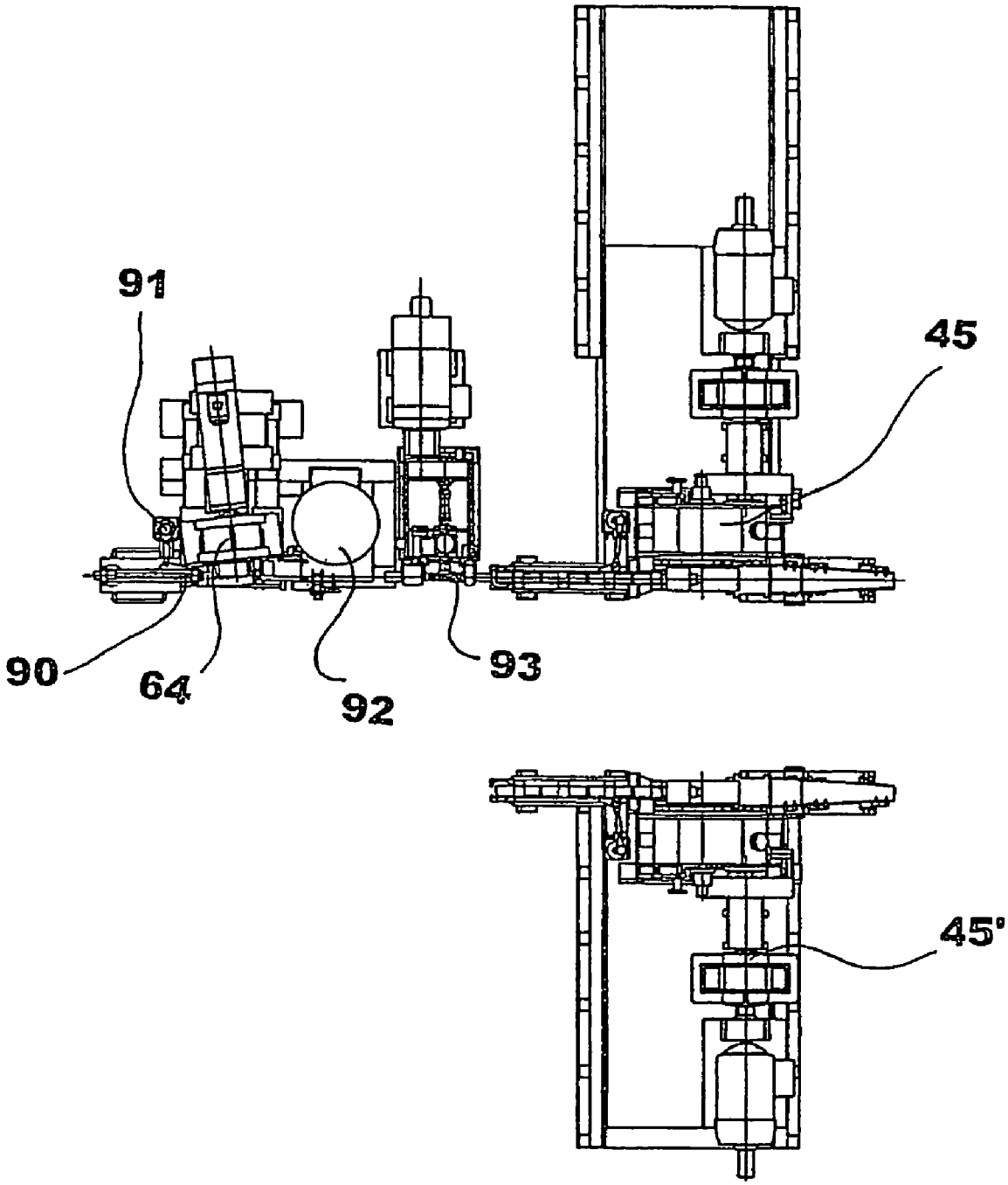
FIG. 6 is a plan view of the scrap shear/cutting-to-length shear assembly, with a second cutting-to-length shear installed in parallel.

According to one advantageous embodiment, the packing plant comprises two cutting-to-length shears 45, 45' in parallel (FIG. 6), one of which is used while the second is on stand-by for servicing, thus enabling continuous production throughout the entire life of the set of blades being used, with a maximum downtime of just 5 minutes in order to change the shear using a traverse trolley, not illustrated in the drawings.

When the bars leave the rolling mill their head ends are not always an equal distance apart. This means that, when a rolled bar arrives beneath the shear 45, which rotates continuously at a constant speed, the blades are in a position such that they do not meet at the right point. This results in errors on the first cut. The shearing position error also occurs on the last segment of a bar since the intermediate shearing values are equal to a given number of blade revolutions, which is necessarily a whole number.

The first segment that is cut will be longer than the required length, while the last segment will be shorter.

Thus in another advantageous embodiment, upstream of the cutting-to-length shear 45, there may be a scrap shear 64 as a means of ensuring that all the bar segments of each rolled bar are the same length, in particular the first and last segments.

Both the scrap shear 64 and the cutting-to-length shear 45 rotate continuously at a constant angular speed and at a peripheral speed that is the same as the speed of the rolling process, for example 40m/s, and the distance between said machines is a sub-multiple of the standard length to be cut, for example 2 meters. Upstream of the scrap shear 64 there is a single-channel deflector device 90 that tilts alternately along a horizontal plane in order to direct the rolled bar longitudinally either towards the scrap shear 64 or towards the cutting-to-length shear 45.

For each rolled bar, the shearing cycle is performed as follows: after leaving the last rolling stand, the single-channel deflector device directs the head end of the bar towards the scrap shear 64, which trims the head and the end segment that has been cut off is sent to a suitable collection chamber 92. As soon as the head end has been trimmed, said deflector device 90, which is controlled by means of a cam 91, directs the bar towards the cutting-to-length shear 45 through which said bar passes for a distance that is equal to the standard length required (6, 8, 12 meters); at the precise moment in which the required length is reached, the blades cross and the first bar segment is cut to size.

Subsequent cutting operations are performed with the single-channel deflector device 90 positioned so as to allow the bar to advance towards the cutting-to-length shear 45 that cuts the various segments to the predefined length, since the distance between the blades is equal to said length and the peripheral speed of said blades is the same as the speed at which the rolled bar is delivered.

In order to cut even the last segment of the rolled bar to the correct length, when the tail end of the bar leaves the rolling unit, the single-channel deflector device directs the tail end towards the scrap shear 64: in this case the blades of the scrap shear cut the last segment of the bar to the correct length and at the same time trim the tail. More precisely, when the second-to-last bar segment has been cut, the head end of the last segment is allowed to pass through the cutting-to-length shear 45 until the sum of the part of the bar that has passed through said shear and the part of the bar between the center-to-center distance of the two blades, of the scrap shear and cutting-to-length shear, equals the predefined length: at that moment the end part of the rolled bar is in the point at which the scrap shear blades cross and these cut the bar to the correct length. Also in this case the end part that has been cut off is sent to the collection chamber.

The blades of the cutting-to-length shear 45 are synchronized with those of the scrap shear 64 so that, when the first and last segments are cut, with simultaneous trimming respectively of the head and tail of the rolled bar, said blades are in the correct position at the predefined moment to cut the first and last segments to the predefined length. The synchronization of said blades must take into account the distance between the two shears 64 and 45, their speed of rotation, the speed at which the rolled bar advances and the angular position of the blades. For that purpose the plant according to this invention incorporates sensors, which comprise: means for measuring the speed at which the rolled bar is being fed and for detecting its position on the feed line in relation to the cutting point, means for measuring the angular position of the blades, and calculation means.

Furthermore, since the scrap and cutting-to-length blades rotate continuously, the single-channel deflector device and the rotation of said blades, the position of which must be known at all times, must also be synchronized. For this purpose synchronization means are included, such as, for example, electronic means, between said deflector device and the continuously rotating blades of the two shears 64, 45.

A feeding device 93, installed downstream of the scrap shear 64, may facilitate the passage of the bars through the cutting-to-length shear 45.

According to another advantageous alternative embodiment, bars can be cut slightly longer or shorter than the standard length, to satisfy specific market requirements, for example lengths of 5.7 m or 6.3 m, without altering the distance between the blades of the shears 64, 45, which is engineered to ensure precision. This is done by changing the speed of rotation of the drums of the shears 64, 45 to obtain the desired length as a function of the speed at which the rolled bar is delivered and the distance of the blades along the circumference of the drums. In particular, the motors associated with the blade holder drums of the scrap shear 64 and the cutting-to-length shear 45 are allowed to oscillate, i.e. they are accelerated so as to obtain overspeeding of the drums in relation to their nominal speed of rotation.

Other alternative embodiments of the packing plant may also comprise:

two feeding devices 70 on the two lines leading out of the cutting-to-length shear 45;

two bar segment bundling or packaging units 71;

two vertical elevators 72 associated with the respective horizontal roller conveyers to unload the bar segments;

two bar segment binding machines 73;

two roller conveyers 74 for transporting bundles or packs;

two bundle or pack collection bag assemblies 75.

With the use of these components the packing plant is capable of producing packs or bundles of bar segments ready for distribution.

The specific embodiments described in this document are not limitative and this patent application covers all the alternative embodiments of the invention as set forth in the claims.

The invention claimed is:

1. Bar packing plant comprising:

means for transporting a bar of an undefined length along a trajectory parallel to an axis of the bar at a first speed;

cutting-to-length devices to cut the bar into segments of a predefined length;

means for diverting the bar segments in order to send said bar segments along a plurality of predefined directions;

speed changing devices to adjust the speed of the bar segments so that said bar segments are delivered at predefined speeds other than the first speed;

one or more pairs of cylinders installed side by side, defining respective axes and rotating about the respective axis, in which the cylinders have a plurality of seats along their respective perimeters, said seats being basically parallel to the axis of the respective cylinder, of a length that is at least twice that of the bar segments and having a proximal portion and a distal portion with respect to said speed changing devices and in which each of said predefined directions is parallel to the axis of a respective cylinder; and conveyor means, each associated with and serving one of the proximal and distal portions of the seats, that transfer the bar segments to a subsequent packing station, after said segments have been unloaded from the seats in the cylinders.

2. Plant according to claim 1, wherein the means for diverting the bar segments comprise two deflector devices.

3. Plant according to claim 1, wherein the means for transporting the bar comprise feeding devices installed upstream of the means for diverting.

4. Plant according to claim 1, wherein the subsequent packing station comprises means for packing the bar segments.

5. Plant according to claim 1, wherein the cutting-to-length devices comprise a first shear.

6. Plant according to claim 5, comprising a second shear installed parallel to the first shear.

7. Plant according to claim 5, comprising a scrap shear that operates in line with and is synchronized with the first shear.

8. Plant according to claim 1, comprising vertical elevators associated with respective horizontal roller conveyors, each vertical elevator being installed beside a respective pair of cylinders.

9. Plant according to claim 1, wherein said packing station comprises binding machines to bind packs of segments.

10. Plant according to claim 9, wherein said packing station comprises bags to collect the packs.

11. Plant according to claim 10, comprising roller guideways to unload the packs of segments.

12. Plant according to claim 1, wherein the conveyor means comprise double-threaded worms.

13. Plant according to claim 12, wherein each pair of cylinders cooperates with one or more of the respective worms, other than the worm or worms of the other pair of cylinders.

14. Method for packing bars performed by means of a plant comprising the following steps:

providing the bar packing plant of claim 1;

a) cutting a bar of an undefined length into bar segments of a predefined length by use of the cutting-to-length devices;

b) diverting the bar segments towards a plurality of predefined lines by use of the means for diverting the bar segments;

c) modifying the speed of the bar segments until the respective predefined speeds have been reached by use of the speed changing devices;

d) cyclically feeding each bar segment, by means of an axial translation movement, alternately first into the portion of a first seat that is furthest from the speed changing devices and then into the portion closest to the speed changing devices of a second seat adjacent to the first, or vice versa, by use of the cylinders having a plurality of seats along their respective perimeters;

e) unloading each bar segment from a portion of a seat onto the conveyor means, associated with said portion; and f) transferring the bar segments to a subsequent packing station.

15. Method according to claim 14, wherein each bar segment is fed into the respective seat, in sequence, first in a first cylinder of different pairs and then in a second cylinder of the same pairs.

16. Method according to claim 15, wherein each bar segment is unloaded in sequence first from a first cylinder of pairs of different cylinders and then from a second cylinder of the same pairs.

* * * * *